US007070544B1

(12) United States Patent
Rindfleisch

(10) Patent No.: US 7,070,544 B1
(45) Date of Patent: Jul. 4, 2006

(54) ISOLATION EXERCISE MACHINE WITH LEVERAGE ARM

(76) Inventor: Randy Rindfleisch, 810 N. 28th St., Sheboygan, WI (US) 53081

( * ) Notice: Subject to any disclaimer, the term of this patent is extended or adjusted under 35 U.S.C. 154(b) by 408 days.

(21) Appl. No.: 10/353,356

(22) Filed: Jan. 30, 2003

(51) Int. Cl.
*A63B 21/06* (2006.01)
*A63B 21/08* (2006.01)
*A63B 23/00* (2006.01)

(52) U.S. Cl. ..... 482/97; 482/100; 482/137

(58) Field of Classification Search ..... 482/37, 482/93, 94, 97–100, 133–138, 907, 908; D21/673, 675, 676
See application file for complete search history.

(56) References Cited

U.S. PATENT DOCUMENTS

| | | | | |
|---|---|---|---|---|
| 3,010,720 | A | 11/1961 | Allard | |
| 4,231,570 | A | 11/1980 | Reis | |
| 4,262,901 | A | 4/1981 | Faust | |
| 4,306,715 | A | 12/1981 | Sutherland | |
| 4,357,010 | A | 11/1982 | Telle | |
| 4,368,884 | A | 1/1983 | Colvin | |
| 4,405,128 | A | 9/1983 | Mclaughlin et al. | |
| 4,411,425 | A | 10/1983 | Milnar | |
| 4,461,473 | A * | 7/1984 | Cole | 482/106 |
| 4,527,797 | A | 7/1985 | Slade, Jr. et al. | |
| 4,635,930 | A | 1/1987 | Cormier | |
| 4,722,522 | A | 2/1988 | Lundgren | |
| 4,757,998 | A | 7/1988 | Landin | |
| 4,765,611 | A | 8/1988 | MacMillan | |
| 4,799,673 | A | 1/1989 | Selle | |
| 4,826,155 | A | 5/1989 | James | |
| 4,840,373 | A * | 6/1989 | Maag | 482/97 |
| 4,854,578 | A * | 8/1989 | Fulks | 482/100 |
| 4,872,670 | A | 10/1989 | Nichols | |
| 4,917,379 | A | 4/1990 | Maag | |
| 4,923,195 | A | 5/1990 | Calderone | |
| 5,006,004 | A | 4/1991 | Dirksing et al. | |
| 5,011,140 | A | 4/1991 | Adessi | |
| 5,044,631 | A | 9/1991 | Jones | |

(Continued)

FOREIGN PATENT DOCUMENTS

| | | |
|---|---|---|
| FR | 1447999 | 6/1966 |

(Continued)

OTHER PUBLICATIONS

Nebula Fitness Equipment by Proto Weld Inc., Seated Calf #6070, catalog received at PTO Sep. 1995.

*Primary Examiner*—Gregory L. Huson
*Assistant Examiner*—Victor K. Hwang
(74) *Attorney, Agent, or Firm*—Ryan Kromholz & Manion, S.C.

(57) ABSTRACT

An isolation exercise machine comprises two force stations and a connection mechanism that causes the force stations to rotate in opposite directions in response to applying forces to the force stations. The forces overcome first loads due to weights placed on exercise arms to which the force stations are joined. The force stations are located relative to a support that enables a person on the support to exercise selected pairs of muscles. A leverage arm is attached to the connection mechanism for rotating with one or the other force station. At the end of a concentric muscle function, a spotter applies a small force to the leverage arm. The applied force is converted by the connection mechanism into second loads at the force stations that the person resists during an eccentric muscle function. A counterweight arm and counterweight may be used to cancel out the weight of the leverage arm.

31 Claims, 8 Drawing Sheets

U.S. PATENT DOCUMENTS 5,050,873 A 9/1991 Jones
D321,026 S 10/1991 Jones
D321,027 S 10/1991 Jones
5,052,684 A * 10/1991 Kosuge et al. ..... 482/118
D321,387 S 11/1991 Jones
D321,389 S 11/1991 Jones
D321,390 S 11/1991 Jones
D321,391 S 11/1991 Jones
5,066,003 A 11/1991 Jones
5,100,080 A 3/1992 Servanty
5,108,095 A 4/1992 Nichols
5,116,297 A 5/1992 Stonecipher
5,125,881 A 6/1992 Jones
5,135,449 A 8/1992 Jones
5,135,456 A 8/1992 Jones
5,141,480 A 8/1992 Lennox et al.
5,171,198 A 12/1992 Jones
5,180,354 A 1/1993 Jones
5,181,896 A 1/1993 Jones
5,183,452 A 2/1993 Bacon et al.
5,194,060 A 3/1993 Marchetti
5,217,421 A 6/1993 Chrysler
5,273,504 A 12/1993 Jones
5,273,505 A 12/1993 Jones
5,281,193 A 1/1994 Colbo, Jr.
5,306,220 A 4/1994 Kearney
5,310,393 A 5/1994 Highsmith
5,346,448 A 9/1994 Sollo
5,358,462 A 10/1994 Calderone
5,518,482 A * 5/1996 Hsieh ..... 482/130
5,562,577 A 10/1996 Nichols
5,613,928 A * 3/1997 Laudone ..... 482/139
5,643,152 A * 7/1997 Simonson ..... 482/100
5,667,464 A * 9/1997 Simonson ..... 482/97
5,755,823 A 5/1998 Cleary
5,769,757 A * 6/1998 Fulks ..... 482/45
5,788,605 A * 8/1998 Kuo ..... 482/5
5,810,701 A * 9/1998 Ellis et al. ..... 482/136
5,833,585 A * 11/1998 Jones et al. ..... 482/97
6,224,518 B1 5/2001 Weiss et al.
6,394,937 B1 * 5/2002 Voris ..... 482/139
6,500,106 B1 * 12/2002 Fulks ..... 482/137
2002/0198088 A1 * 12/2002 Vuurmans et al. ..... 482/99

FOREIGN PATENT DOCUMENTS

FR 2561528 9/1985
FR 2612406 A1 * 9/1988
GB 2232089 12/1990
WO WO 89/01805 3/1989

* cited by examiner

ISOLATION EXERCISE MACHINE WITH LEVERAGE ARM

BACKGROUND OF THE INVENTION

1. Field of the Invention

This invention pertains to machines for exercising human muscles, and more particularly to isolation exercise machines that impose different loads on a exercising person during concentric and eccentric muscle functions.

2. Description of the Prior Art

Various types of exercise machines have been developed to exercise human muscles. In general, exercise machines fall into one of two broad groups: machines for exercising multiple pairs of muscles at one time, and machines that exercise only one pair of muscles at a time. The first broad group of machines is frequently referred to as compound machines. The second group is often referred to as isolation machines.

Regardless of whether one or several pairs of muscles are being exercised, the muscles can function in three different ways. The first is a positive or concentric function in which the muscles contract against a load that is less than the muscle strength. The second way is a static or isometric function in which the muscle attempts but is unable to contract against a load that is greater than the muscle strength. The third muscle function is a negative or eccentric function in which an external load is large enough to overcome the muscle strength and force the muscle to elongate in spite of an attempt by the person to contract the muscle.

Examples of prior compound exercise machines include those marketed by Powertec Direct Company of Milford, Pa. The Hammer Strength Company of Cincinnati, Ohio, and Promaxima Manufacturing Limited of Houston, Tex., also market respective lines of mechanical exercising equipment. None of the machines available from the foregoing companies is capable of increasing the load a person must resist during eccentric muscles functions compared with the concentric muscle functions.

Exemplary compound exercise machines are disclosed in my co-pending U.S. patent application Ser. No. 10/233,036 filed Sep. 30, 2002. The machines of that application include leverage arms that are pivoted to a frame. Weights of desired size are hung from the leverage arms. The exercising person pivots the leverage arm and lifts the weights during concentric muscle functions. A spotter applies a small additional force to the leverage arm during eccentric muscle functions. The small applied force imposes an additional load that the person must resist during the eccentric muscle function.

The three companies mentioned above also market isolation exercise machines. Typical prior isolation machines exercise the pectoral muscles, inner thighs, lateral deltoid muscles, posterior deltoid muscles, and latisimus dorsi muscles. The prior machines usually included a series of cables and cams that operated to raise and lower a weight during the exercise routines.

U.S. Pat. No. 5,125,881 shows an isolation exercise machine for exercising the rear deltoid muscles. The machine of that patent comprises two independently pivotable levers each having a weight and a counterweight. The levers are pivoted in response to pushing against the levers with the backs of a person's upper arms. U.S. Pat. No. 5,171,198 teaches an isolation machine having independently pivotable levers with weights and counterweights for exercising the lateral deltoid muscles.

Like the compound exercise machines presently available, the prior isolation exercise machines also impose the same load on an exercising person during both concentric and eccentric muscle functions. Thus, a need exists for an isolation exercise machine that takes full advantage of the capabilities of human muscles during eccentric functions.

SUMMARY OF THE INVENTION

In accordance with the present invention, an isolation exercise machine is provided that is capable of imposing different loads on an exercising person during concentric and eccentric muscle functions. This is accomplished by apparatus that includes a leverage arm that rotates in unison with one or the other of two force stations.

The force stations are joined to each other by a connection mechanism. According to one aspect of the invention, the connection mechanism comprises a pair of exercise arms and a drive train that produces opposite rotations of the exercise arms. Each exercise arm includes a shaft that is journalled for rotation in a tripod frame. Each exercise arm includes at least one beam to which the associated force station is mounted. Each exercise arm may also have a second beam that removeably holds a first weight. When the isolation exercise machine is at rest, the first weights are generally underneath the shafts of the associated exercise arms. Rotating the exercise arms from their rest positions raises the first weights. The force stations are adjustable on the exercise arms to suit the particular exercising person and the muscles to be exercised.

In a preferred embodiment, the drive train is comprised of two sprockets on each exercise arm shaft. A first chain is fixed to a first pair of the sprockets. A second chain is fixed to the other pair of the sprockets. The two chains are arranged in a figure-eight configuration so as to produce the opposite rotations in the exercise arm shafts.

In order to rotate with a particular force station, the leverage arm may be attached to the exercise arm associated with that force station. Preferably, however, the leverage arm is attached to the drive train. For example, one end of the leverage arm may be attached to a sprocket of a chain and sprocket drive train. Rotation of either exercise arm thus causes rotation of the leverage arm as well as of the other exercise arm. The leverage arm may have a weight bar for removeably holding a second weight.

The isolation exercise machine frame is designed with a support that supports an exercising person. The support is constructed to suit the particular muscles that are to be exercised. For example, the support my be a horizontal bench that supports a person lying horizontally. Alternately, the support may be in the general form of a seat with or without a back rest or chest rest.

To use the isolation exercise machine of the invention, the exercising person places the desired first weights on the second beams of the exercise arms. A second weight may be placed on the leverage arm instead of or in addition to the first weights on the exercise arms. The person positions himself in the appropriate manner on the support and places the desired limbs adjacent the corresponding force stations. The person exerts a concentric muscle function against both force stations simultaneously. Doing so overcomes the loads imposed by the weights and rotates the exercise arms and raises the weights. That action also causes the leverage arm to rotate such that its second end is at a higher elevation that it was at the start of the concentric muscle function.

At the end of the concentric muscle function, a spotter applies a small force to the leverage arm. The applied force creates an applied torque on the shaft associated with the sprocket to which the leverage arm is attached. Because of the length of the leverage arm, a small applied force creates a significant applied torque on the sprocket shaft. The connection mechanism converts the applied torque into equal and opposite applied loads at the force stations. The applied loads are additive to the loads imposed by the weights. During the eccentric muscle function, therefore, the person exerts a force on each force station that resists the sum of the loads due to the weights plus the small force applied to the leverage arm. At the end of the eccentric muscle function, the spotter removes the small force from the leverage arm. The exercising person then repeats the concentric muscle function, again overcoming only the load imposed by the first and/or second weights, and the cycle repeats. In that manner, the person makes maximum use of his different muscle abilities during concentric and eccentric functions.

The weight of the leverage arm itself creates a leverage arm torque on the shaft associated with the sprocket to which the leverage arm is attached. The leverage arm torque is converted by the connection mechanism into additional loads at the two force stations. The loads at the force stations due to the leverage arm weight are additive to the loads due to the weights. In some instances, it may desirable to negate the weight of the leverage arm such that the person must overcome only the loads of the weights. In those situations, the isolation exercise machine of the invention is designed with a counterweight arm and counterweight that cancel out the weight of the leverage arm. For a connection mechanism that uses a chain and sprocket drive train, the counterweight arm may be joined to any of the sprockets.

It is an important feature of the invention that it is adaptable to exercising a wide variety of muscles. In one embodiment, the support of the isolation exercise machine is in the form of a bench. The bench is so located relative to the force stations as to enable the exercising person to exercise the pectoral muscles. The bench-type support is also suitable for exercising the inner thigh, posterior deltoid, lateral deltoid, and latisimus dorsi muscles. For each type of muscle to be exercised, the same laws of physics are used by the leverage arm and the small force applied to it by a spotter during eccentric muscle functions. Accordingly, maximum efficiency is attained when exercising the particular muscles.

The method and apparatus of the invention, using a leverage arm in conjunction with a connection mechanism, thus converts a torque created by a selectively applied force to the leverage arm into additional loads at the force stations. The full ability of the exercising person to resist greater loads during eccentric muscle functions than he overcomes during concentric muscle functions is realized, even though the spotter need apply only a small force to the leverage arm.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figures 1, 4:
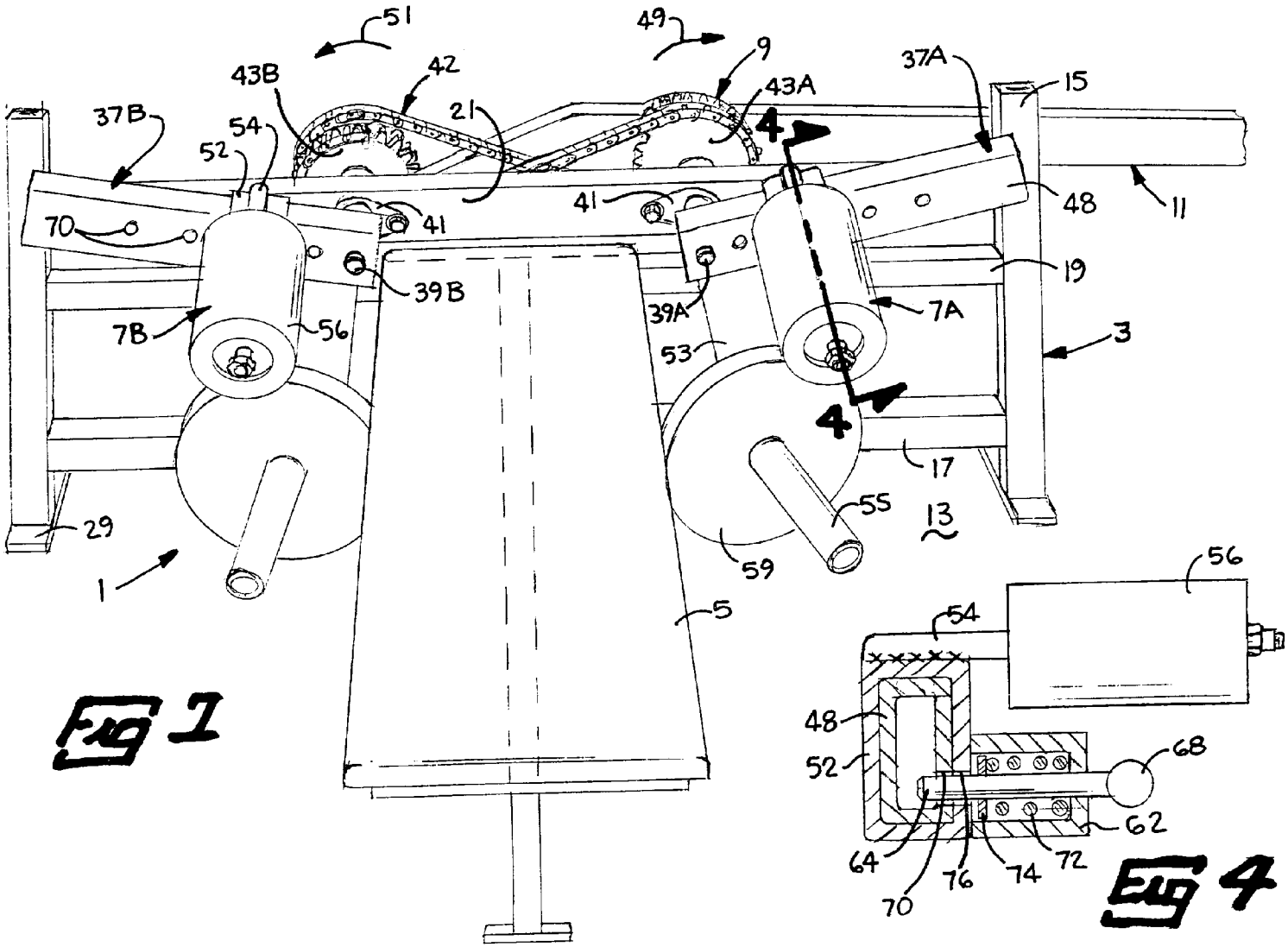
FIG. 1 is a perspective view of an isolation exercise machine according to the present invention.
FIG. 4 is a cross-sectional view taken along line 4—4 of FIG. 1.
Figure 2:
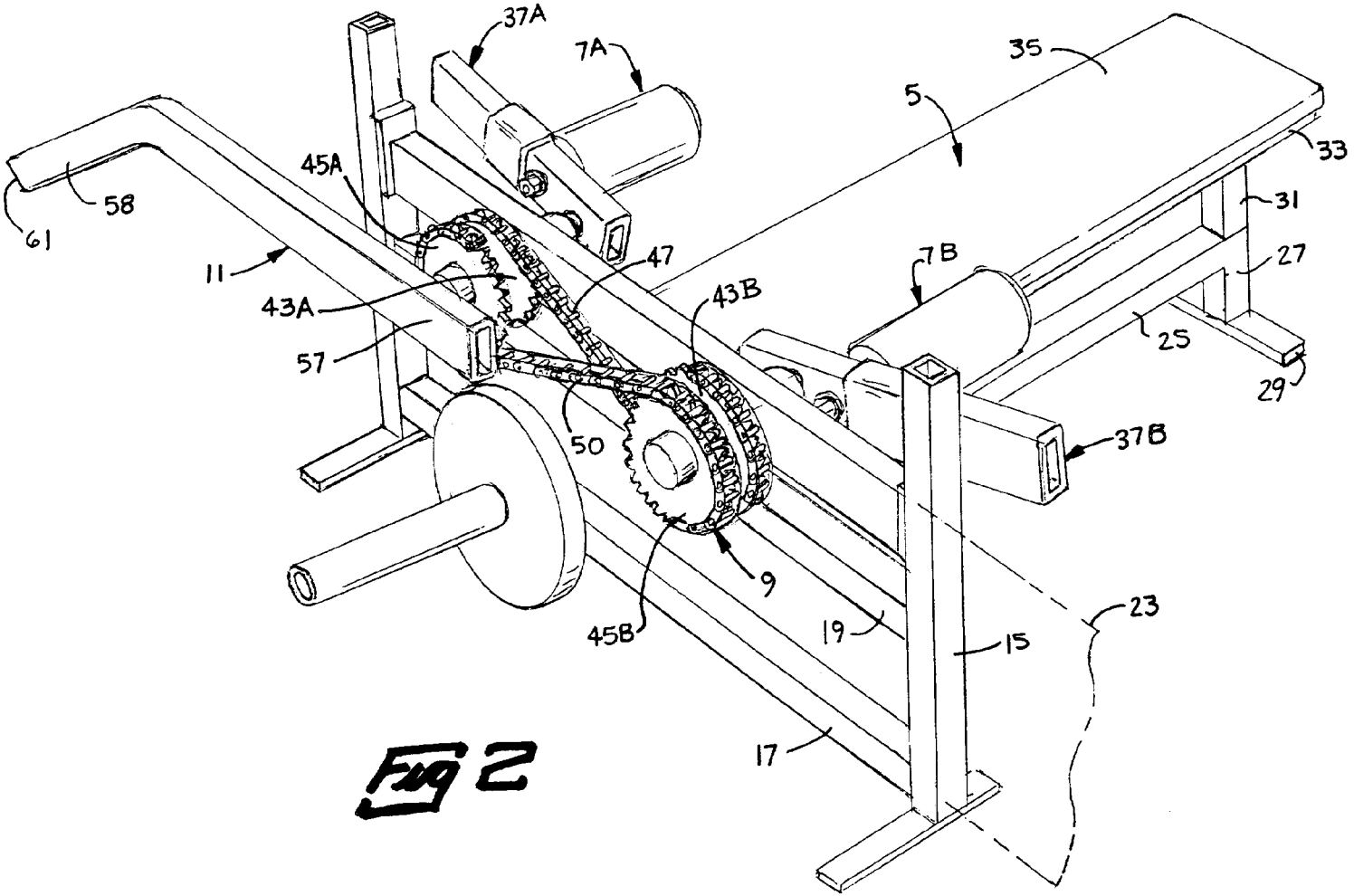
FIG. 2 is a view of the connection mechanism of the isolation exercise machine of the invention.

Referring to FIGS. 1 and 2, an isolation exercise machine 1 is illustrated that includes the present invention. The isolation exercise machine 1 is particularly useful for imposing different loads on human muscles during concentric and eccentric functions.

The isolation exercise machine 1 is comprised of a frame 3, a support 5, a pair of force stations 7A and 7B, a connection mechanism 9, and a leverage arm 11. The force stations 7A and 7B are located relative to the support 5 to enable an exercising person to position himself on the support and comfortably place the desired limbs against the force stations. Exerting muscle forces against the force stations causes the force stations to rotate in opposite directions.

The frame 3 is preferably constructed as a tripod having a stable three-point contact with a floor 13. For that purpose, the frame has two upstanding posts 15 connected by one or more cross-braces. In the particular construction illustrated, there are three cross-braces 17, 19, and 21. The posts 15 and the cross-braces 17, 19, and 21 define a vertical plane 23. A horizontal stabilizer 25 is perpendicular to the plane 23. One end of the stabilizer 25 is secured to the cross-brace 17. On the other end of the stabilizer is a stub post 27. There is a foot 29 on the lower end of each of the posts 15 and 27 that rests on the floor 13. The feet 29 cooperate with each other to form a stable three-point contact with the floor.

In the isolation exercise machine 1, the support 5 is in the form of a horizontal bench. A vertical leg 31 upstands from the frame stub post 27. A cross-plate 33 is between the vertical leg 31 and the frame cross-brace 19. A horizontal pad 35 is on the cross-plate 33 as well as on the cross-brace 19. The pad 35 may be a sturdy wooden board covered with a comfortable padding and durable cover.

The connection mechanism 9 causes the force stations 7A and 7B to rotate in opposite directions in response to rotating either one of them. In the preferred embodiment, the connection mechanism is comprised of a pair of exercise arms 37A and 37B to which the force stations 7A and 7B, respectively, are joined. Each exercise arm 37A and 37B includes a respective shaft 39A and 39B. The shafts 39A and 39B are journalled for rotation in the frame 3, as by respective pillow blocks 41 on the cross-brace 21.

The exercise arms 37A and 37B are connected to each other by a drive train 42. The drive train may be any of several constructions that produce opposite rotations of the exercise arms. Typical examples include gears, and pulleys with belts or cables. In the particular drive train 42 illustrated, the drive train includes a first sprocket 43A and a second sprocket 45A on the shaft 39A. Similar sprockets 43B and 45B are on the shaft 39B. The sprockets 43A and 43B constitute a first pair, and they are connected by a chain 47. The chain 47 has one end that is fixed to the sprocket 43A and a second end that is fixed to the sprocket 43B. The chain 47 is so fixed to the sprockets 43A and 43B that turning the shaft 39A in the direction of arrow 49 causes the shaft 39B to turn in the direction of arrow 51. However, turning the shaft 39A in the direction of arrow 51 has no effect on the shaft 39B. Turning the shaft 39B in the direction of arrow 49 causes the shaft 39A to turn in the direction of arrow 51, but turning the shaft 39B in the direction of arrow 51 has no effect on the shaft 39A.

The sprockets 45A and 45B constitute a second pair, and they are connected by a second chain 50. The second chain 50 has first and second ends that are fixed to the sprockets 45A and 45B, respectively. The chains 47 and 50 are arranged in a figure-eight configuration that results in the shafts 39A and 39B always rotating in opposite directions 49 and 51 in response to rotating either of the shafts. Consequently, both force stations 7A and 7B rotate in opposite directions in response to rotating either or both of the exercise arms 37A and 37B.

According to one aspect of the invention, each exercise arm 37A and 37B has two beams 48 and 53 that are joined to each other in the vicinity of the respective shafts 39A and 39B. The beams 48 and 53 may be approximately at 90 to 120 degrees to each other. The force stations 7A and 7B are adjustable along the lengths of the beams 48. For that purpose, and also looking at FIG. 4, each force station includes a collar 52 that surrounds and is slideable along the respective beam 48. Welded or otherwise firmly secured to each collar 52 is a rod 54 that is perpendicular to the frame plane 23. A comfortable pad 56 covers most of the rod 54. Also on the collar is a small housing 62. The housing 62 contains a pin 64 that has a handle 68 outside the housing and a flange 74 inside the housing. The pin 64 is reciprocable within the housing and a hole 76 in the collar to lock and release from any of several holes 70 along the beam. A spring 72 biases the pin into a selected beam hole 70 and thereby locks the force station to the beam. Pulling the pin releases it from the beam hole to enable the collar to slide along the beam and thereby adjust the location of the pad 56.

On each beam 53 is a weight bar 55. When the isolation exercise machine 1 is at rest, the weight bars 55 are generally underneath the respective shafts 39A and 39B.

The leverage arm 11 is attached to the connection mechanism 9 such that it rotates in the same direction as one or other shaft 39A or 39B. In the illustrated construction, the leverage arm first end 57 is attached to the sprocket 45A. Accordingly, the leverage arm rotates in the same direction as the exercise arm 37A. The leverage arm has an angled section 58 at its second end 61. The angled section 58 is designed such that the second end 61 is approximately at the level of the floor 13 when the isolation exercise machine 1 is at rest. The leverage arm is preferably between approximately three and six feet long.

Figure 11:
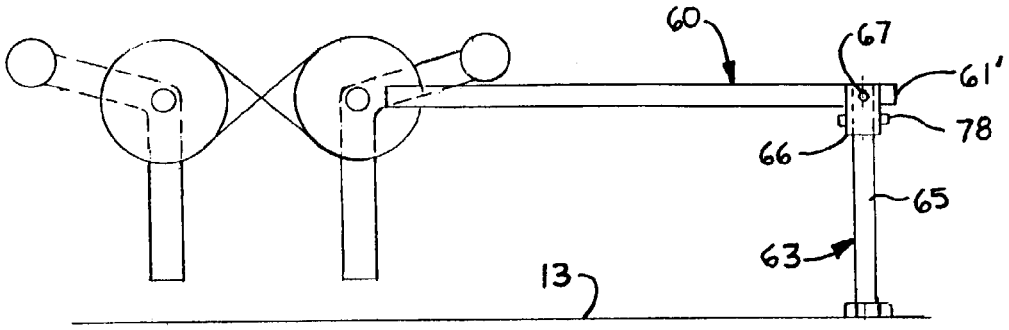
FIG. 11 is a schematic diagram of the invention showing a leverage arm with an adjuster.

Alternately, the leverage arm may be such that its entire length is straight, as is shown at reference numeral 60 in FIG. 11. In that situation, the leverage arm 60 includes an adjuster 63 at the second end 61'. The adjuster 63 comprises a tubular 65 that is slideable within a sleeve 66. The sleeve 66 is pivotable about a pin 67 through the leverage arm 60. The column 65 has a number of pairs of transverse holes through it. A second pin 78 passes through aligned holes in the sleeve and through a selected pair of the transverse holes for receiving the pin 78 enables the height of the leverage arm end 61' above the floor 13 to be adjusted when the isolation exercise machine 1 is at rest.

Figure 3:
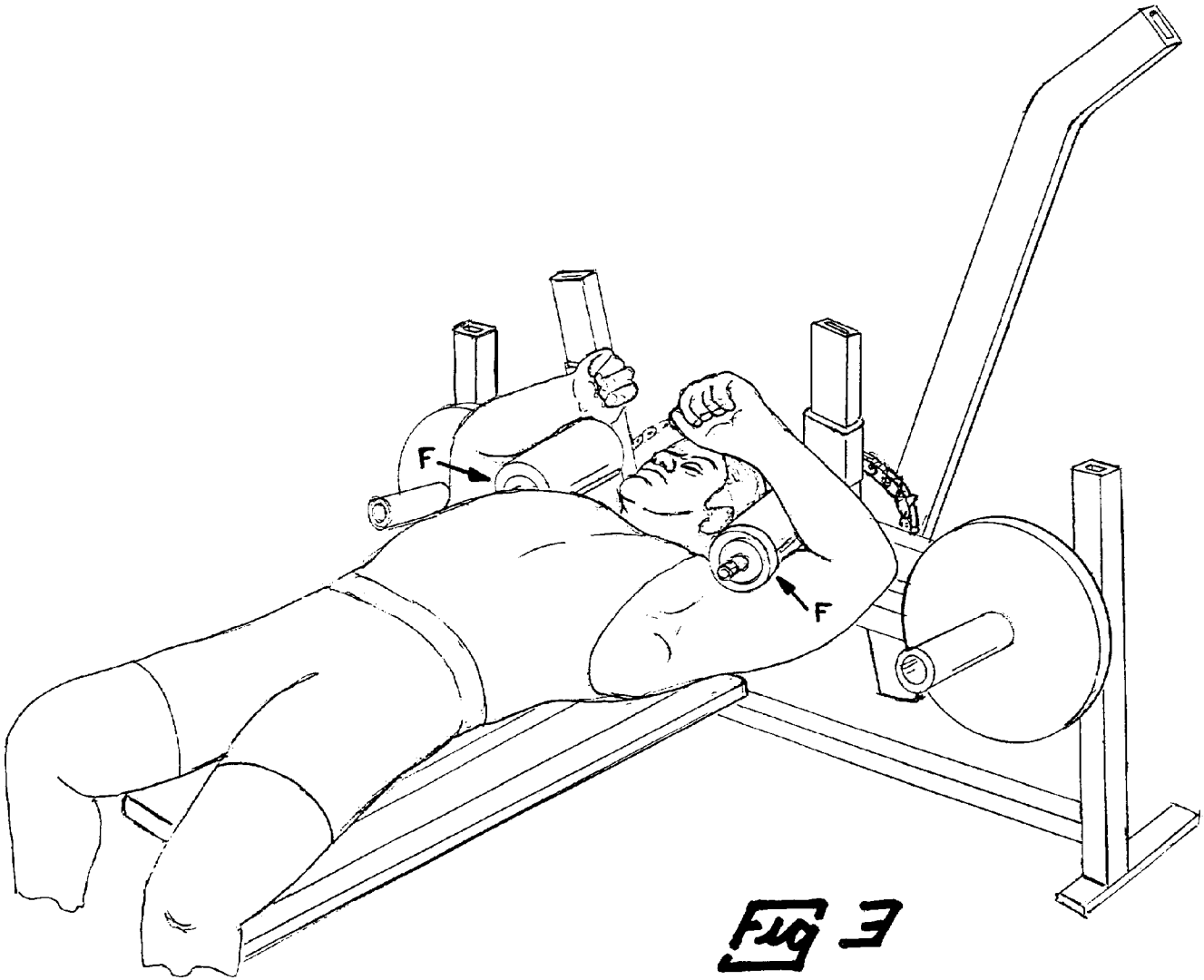
FIG. 3 is a perspective view of the invention at the end of a concentric muscle function when used to exercise the pectoral muscles.
Figure 6:
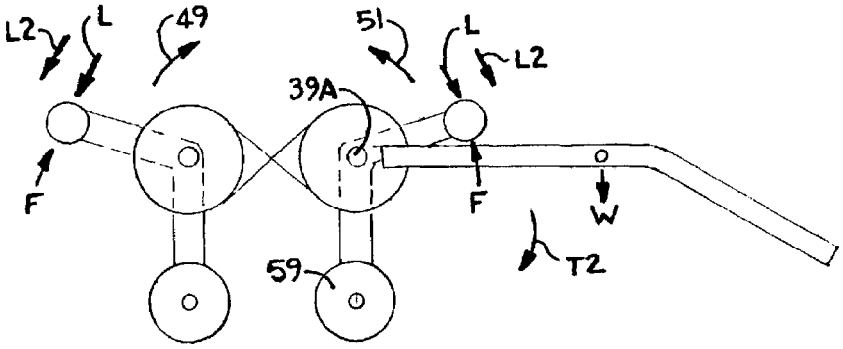
FIG. 6 is a schematic diagram of the isolation exercise machine at the start of a concentric muscle function.
Figure 7:
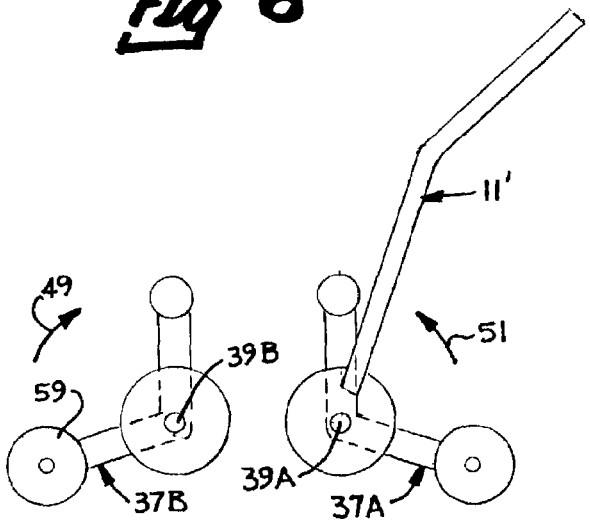
FIG. 7 is a schematic diagram of the isolation exercise machine at the end of a concentric muscle function.

The embodiment of the isolation exercise machine shown at reference numeral 1 is especially useful for exercising the pectoral muscles. To exercise the pectoral muscles, a person places first weights 59 of desired size on the weight bars 55 of the exercise arms 37A and 37B. The person lies face up on the support 5 with his head toward the connection mechanism 9. He adjusts the force stations 7A and 7B along the beams 48 such that the pads 56 are comfortably next to his biceps, FIGS. 3 and 5. He exerts a concentric muscle function of force F with both upper arms using his pectoral muscles to bring his elbows toward each other. Also see FIG. 6. The forces F exerted by the person are resisted by and are slightly greater than the loads L imposed on the person by the weights 59. Consequently, the exercise arms 37A and 37B rotate in the directions of arrows 51 and 49, respectively, and raise the first weights 59, FIG. 7. Rotation of the exercise arms also rotates the leverage arm 11 in the direction of arrow 51 to a position represented at reference numeral 11'.

Figure 8:
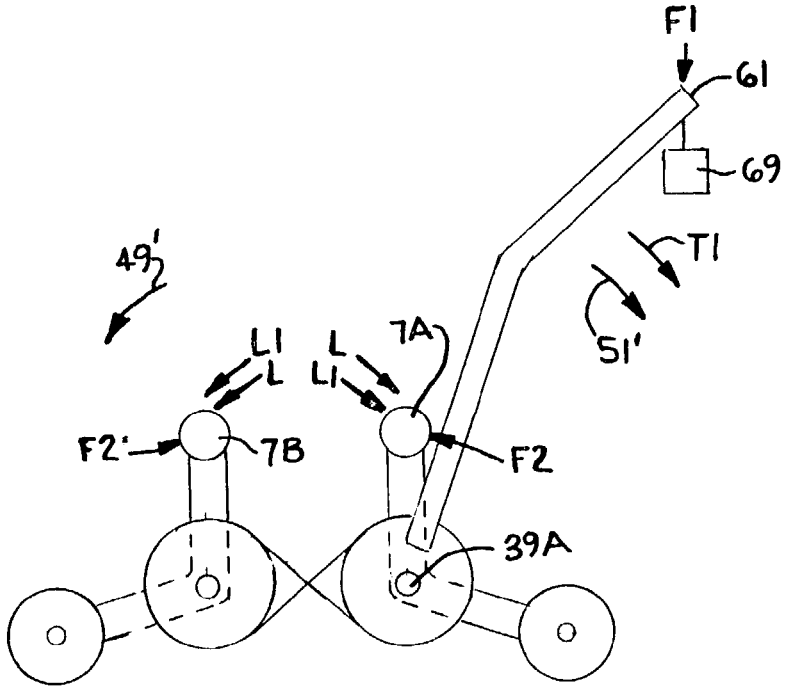
FIG. 8 is a schematic diagram of the isolation exercise machine at the start of an eccentric muscle function.

At the end of the concentric muscle function, a small force F1 is applied to the leverage arm end 61, FIG. 8. The small applied force F1 may be a small weight 69 hung on the end of the leverage arm. Alternately, a spotter may push downwardly with his hands with a slight force on the leverage arm. The applied force F1 acts about the shaft 39A to create an applied torque T1 on it. Because of the length of the leverage arm, the small applied force F1 creates a relatively large applied torque T1 about the shaft 39A. The applied torque T1 is converted by the drive train 42 into applied loads L1 at the force stations 7A and 7B. The applied loads L1 are additive to the loads L due to the weights 59. The sum of the loads L plus L1 is slightly greater than the force F2 that the person is capable of resisting during an eccentric muscle function. As a result, the loads L plus L1 force the person's arms apart during an eccentric muscle function in the directions of arrows 49' and 51'. The amount of the small applied force F1 is chosen to allow the exercising person to perform the eccentric muscle function, exerting the resisting force F2, with complete control as the exercise arms and leverage arm rotate in the directions of arrows 49' and 51' back to the rest position of FIGS. 1 and 5. In that manner, the full capabilities of the pectoral muscles in the eccentric function are utilized, which increases the efficiency of the workout. Moreover, only one spotter is needed to apply the small force during eccentric muscle functions, and the applied torque created by the small applied force is converted equally into the applied loads L1 at both force stations. At the end of the eccentric muscle function, the spotter removes the applied force F1. The exercising person then exerts just the force F to again rotate the exercise arms in the directions of arrows 49 and 51, and the process is repeated.

Figure 9:
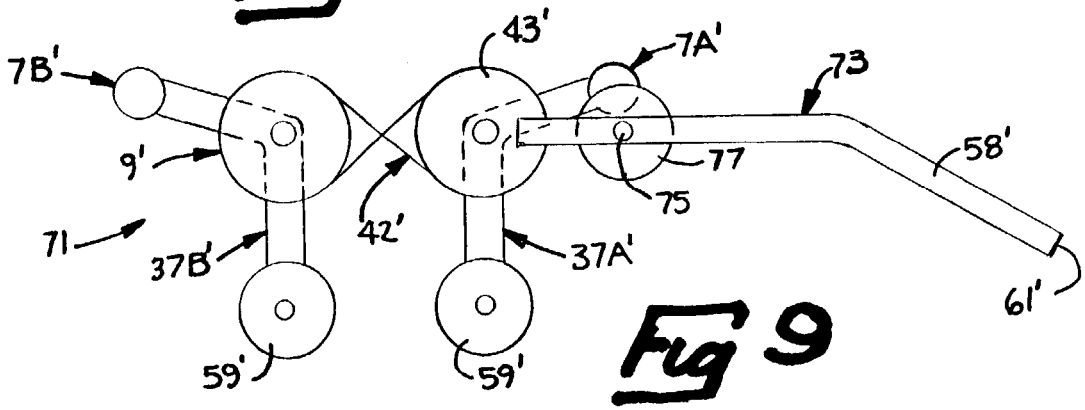
FIG. 9 is a schematic diagram of a modified embodiment of the present invention.

FIG. 9 shows a schematic diagram of a modified isolation exercise machine 71 according to the present invention. The isolation exercise machine 71 has a frame and support not shown but generally similar to the frame 3 and support 5 described previously in connection with the isolation exercise machine 1. The exercise machine 71 further has force stations 7A' and 7B' and a connection mechanism 9'. The connection mechanism 9' is shown as having a chain and sprocket drive train 42', but other types of drive drains are also suitable. One end of a leverage arm 73 is attached to one of the sprockets 43' of the connection mechanism. The leverage arm 73 is depicted as having an angled section 58'. However, if desired, the leverage arm could be straight and have an adjuster similar to the adjuster 63 described previously in conjunction with the isolation exercise machine 1.

On the leverage arm 73 between the sprocket 43' and the end 61' is a weight bar 75. The leverage arm weight bar 75 gives the exercising person the option of placing a weight 77 on the leverage arm in addition to or in place of the weights 59' on the exercise arms 37A' and 37B'.

Figure 10:
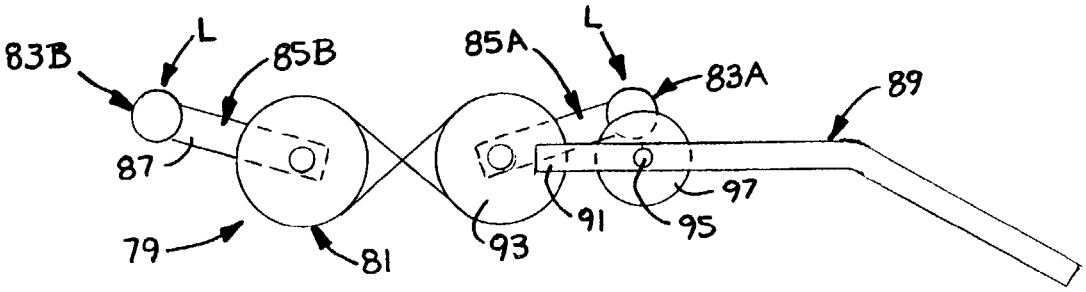
FIG. 10 is a schematic diagram of a further modified embodiment of the present invention.

FIG. 10 shows in diagrammatic form a further isolation exercise machine 79 having a connection mechanism 81 and force stations 83A and 83B. Each exercise arm 85A and 85B has only one beam 87, to which the force station 83A or 83B is mounted.

A leverage arm 89 is attached at one end 91 to one of the connection mechanism sprockets 93. There is a weight bar 95 on the leverage arm 89. A weight 97 placed on the weight bar 95 is sufficient to produce the full loads L at the force stations 83A and 83B during concentric muscle functions. The operation of the isolation exercise machine 79 is substantially identical to that of the isolation exercise machines 1 and 71 described previously.

Figure 5:
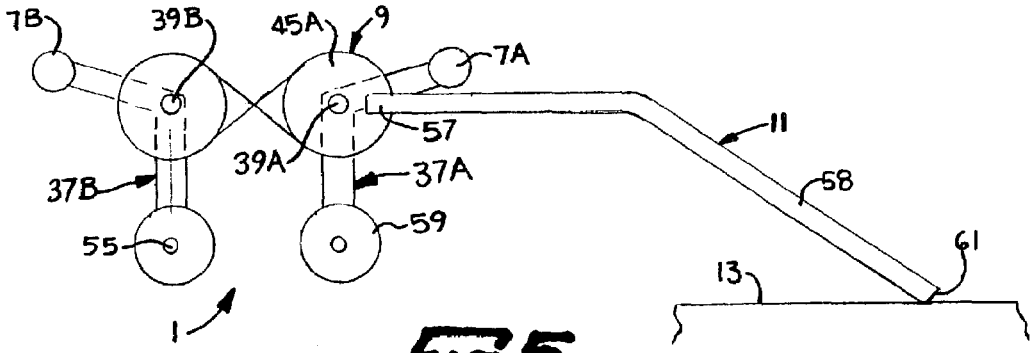
FIG. 5 is a schematic diagram of the isolation exercise machine at rest.

Further in accordance with the present invention, the weight of the leverage arm itself is cancelled out. Returning to FIG. 6, it will be noticed that the weight W of the leverage arm 11 creates a torque T2 about the shaft 39A. The torque T2 due to the leverage arm weight W is converted into loads L2 at the force stations 7A and 7B. The loads L2 are in addition to the loads L from the weights 59 and the loads L2 from the force F1 applied to the leverage arm (FIG. 5). In some situations, it may be desireable to cancel out the loads L2. For example, young persons and persons at the beginning stages of their exercise regimens may not be able or willing to overcome and resist the loads L2.

Figure 12:
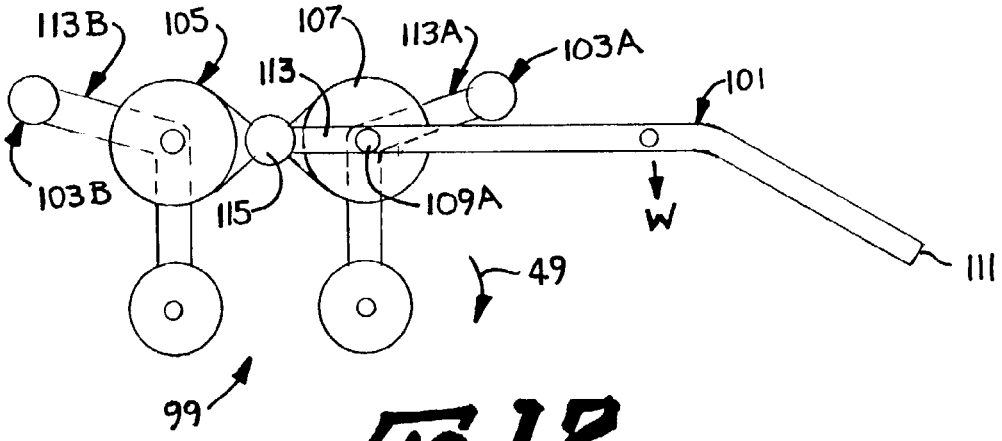
FIG. 12 is a view generally similar to FIG. 5, but showing a counterweight arm.

FIG. 12 shows a schematic diagram of an isolation exercise machine 99 that cancels out the weight W of a leverage arm 101. The exercise machine 99 has force stations 103A and 103B and a connection mechanism 105. The leverage arm 101 is attached to one of the connection mechanism sprockets 107 for rotation about the shaft 109A. To cancel out the weight W, a counterweight arm 113 is joined to the connection mechanism sprocket 107 on the opposite side of the shaft 109A as the leverage arm 101. As illustrated, the counterweight arm 113 is an extension of the leverage arm 101. However, if desired the counterweight arm may be a separate component joined directly to the sprocket 107. A small counterweight 115 is added to the counterweight arm 113. The counterweight 115 acts about the shaft 109A to create a torque that is equal and opposite to the torque created by the weight of the leverage arm. In that manner, the exercising person does not have to exert any force merely to overcome the weight of the leverage arm.

Figure 13:
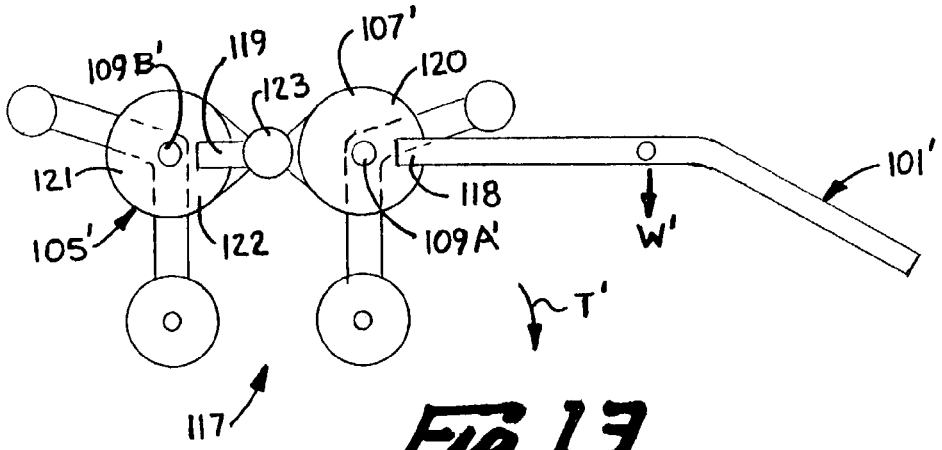
FIG. 13 is a schematic diagram showing an isolation exercise machine with a modified counterweight arm.

FIG. 13 is a schematic diagram of an isolation exercise machine 117 with a modified counterweight arm 119. The first end 118 of a leverage arm 101' is attached to a sprocket 107' on a first side 120 of a shaft 109A'. The counterweight arm 119 is joined to a sprocket 121 on the other shaft 109B'. The counterweight arm is joined to the sprocket 121 on a first side 122 of the shaft 109B'. The first side 122 is on the same side of the shaft 109B' as the first side 120 of the sprocket 107' is on the shaft 109A'. The counterweight arm holds a counterweight 123. The counterweight 123 acts about the shaft 109B' to create a torque that, because of the connection mechanism 105', is in the opposite direction as the torque T' created by the leverage arm weight W' acting about the shaft 109A'. The counterweight arm and counterweight combine to cancel out the weight W' of the leverage arm 101'.

Figure 14:
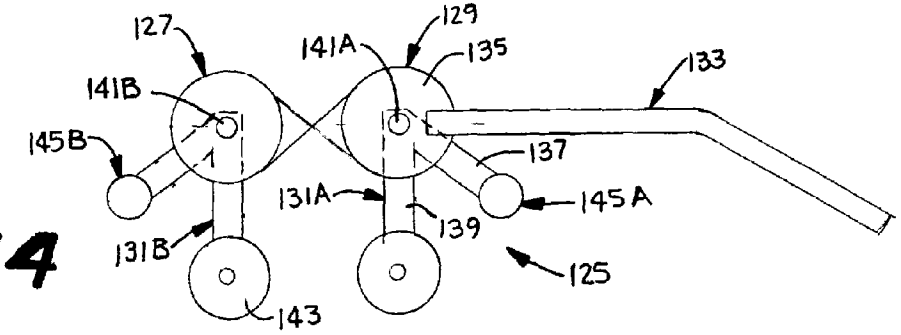
FIG. 14 is a partial schematic diagram of an isolation exercise machine that is particularly useful for exercising posterior deltoid muscles.

An outstanding feature of the present invention is that the same basic isolation exercise machine is used to exercise several different pairs of muscles. As described above, the exercise machine 1 is used primarily to exercise the pectoral muscles. To exercise the posterior deltoid muscles, the machine 125 of FIG. 14 is used. The machine 125 is similar to the the machine 1, having the same tripod frame and support, which are not shown in FIG. 14. The machine 125 further has a connection mechanism 127 composed of a drive train 129 and exercise arms 131A and 131B. A leverage arm 133 is attached to one of the sprockets 135 of the drive train 129. In FIG. 14, the machine 125 is shown without a counterweight arm and also without a weight bar on the leverage arm 133. However, it will be understood that either or both a counterweight arm and a weight bar on the leverage arm 133 could be part of the machine.

Each exercise arm 131A and 131B of the isolation exercise machine 125 has first and second beams 137 and 139, respectively, that are connected to each other in the region of respective exercise arm shafts 141A and 141B. The exercise arm first beams 137 make an acute angle of between approximately 30 and 45 degrees with the respective second beams 139. Weights 143 are placeable on the beams 139. The force stations 145A and 145B are comfortable pads on the beams 137. When the exercise machine 125 is at rest, the weights 143 are generally underneath the associated shafts 141A and 141B.

A person uses the isolation exercise machine 125 by lying face down on the support with his head toward the connection mechanism 127. He adjusts the force stations 145A and 145B on the respective exercise arms 131A and 131B such that his triceps comfortably contact the force station pads, with his arms hanging downwardly toward the floor. He pushes his triceps against the force stations pads using his posterior deltoid muscles in a concentric function to rotate the exercise arms and raise the weights 143. At the end of the concentric muscle function, the person's elbows are approximately in line with his ears. At that point, a spotter applies a small force to the leverage arm 133. The small applied force is magnified and converted into applied loads at the force stations that are resisted by the person during the eccentric muscle function.

Figure 16:
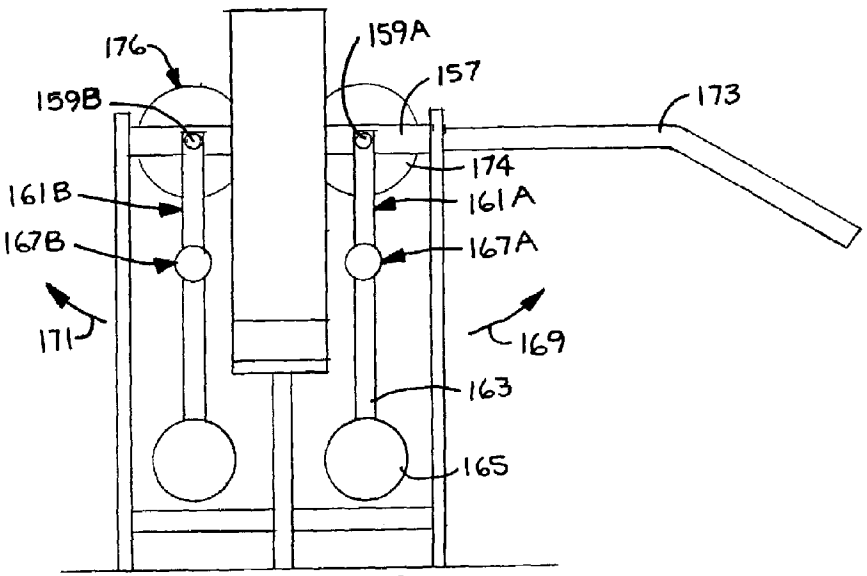
FIG. 16 is a schematic diagram of the front of the isolation exercise machine of FIG. 15.
Figure 15:
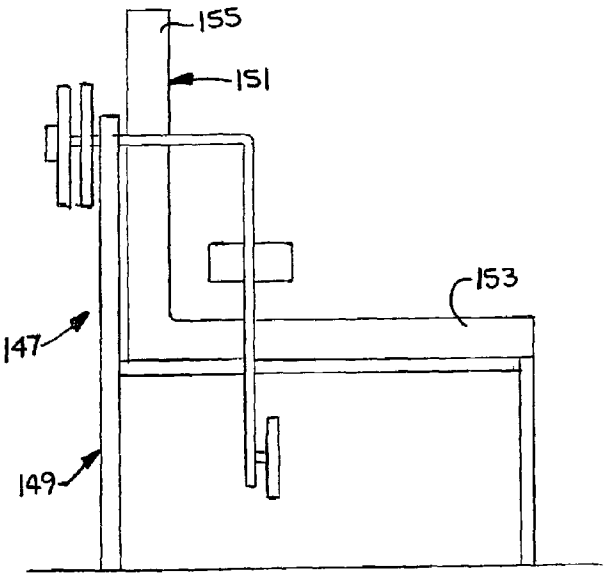
FIG. 15 is a schematic diagram of a side of an isolation exercise machine used to exercise lateral deltoid muscles.

Turning to FIGS. 15 and 16, schematic diagrams of an isolation exercise machine 147 are shown. The exercise machine 147 is used primarily to exercise the lateral deltoid muscles. The machine 147 has a tripod frame 149 that is substantially similar to the frame 3 of the machine 1 described previously. The support 151 of the machine 147 is depicted as having a seat 153 and back rest 155. However, the back rest 155 in not mandatory for the proper functioning of the machine 147. Journalled in a cross-brace 157 of the frame 149 are two shafts 159A and 159B of associated exercise arms 161A and 161B. The exercise arms 161A and 161B are each shown as having a single beam 163. On each beam 163 is a weight 165. Also on each beam is a force station 167A or 167B. A leverage arm 173 is attached to one of the sprockets 174 of a drive train 176.

An exercising person sits on the support seat 153 with his back against the back rest 155, if the support 151 has a back rest. He adjusts the pads of the force stations 167A and 167B so they are next to the outer surfaces of his upper arms. He pushes outwardly and upwardly using the lateral deltoid muscles to rotate the exercise arms 161A and 161B in the directions of arrows 169 and 171, respectively, in a concentric function, thereby raising the weights 165. At the end of the concentric muscle function, the person's elbows are approximately in line with his ears. A spotter applies a small force to the leverage arm 173 for the ensuing eccentric muscle function as previously described.

Figure 17:
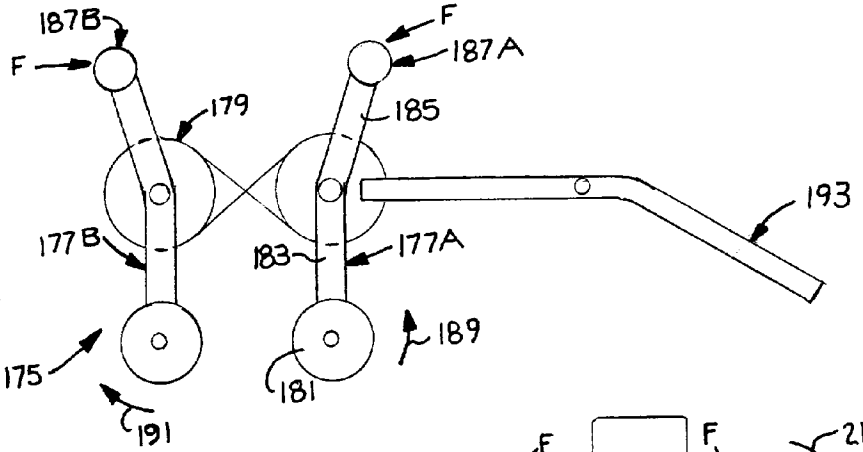
FIG. 17 is a schematic diagram of an isolation exercise machine used to exercise inner thigh muscles.
Figure 19:
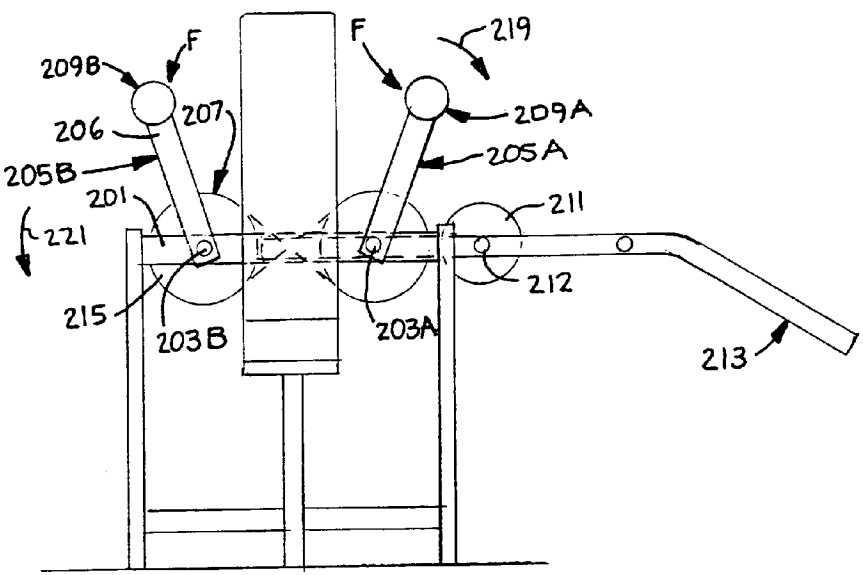
FIG. 19 is a schematic diagram of the front of the isolation exercise machine of FIG. 18.

FIG. 17 shows a partial schematic diagram of an isolation exercise machine 175 that is especially useful for exercising the inner thigh muscles. The exercise machine 175 has a tripod frame and a support that are substantially similar to those of the isolation exercise machine 1 described above. The machine 175 further has exercise arms 177A and 177B connected by a drive train 179. A weight 181 is on a first beam 183 of each exercise arm 177A and 177B. A second beam 185 of each exercise arm makes an obtuse angle of approximately 120 to 150 degrees with the first beam 183. On each second beam 185 is a respective force station 187A and 187B.

A person uses the isolation exercise machine 175 by lying face up on the support, with is head away from the drive train 179. He lifts his legs in the air with the knees spread apart. He places the insides of his knees against the force stations 187A and 187B. He pushes his knees against the force stations in a concentric muscle function as shown by arrows F. By pulling his knees together, the person causes the exercise arms 177A and 177B to rotate in the directions of arrows 189 and 191, respectively, raising the weights 181. At the end of the concentric muscle function, a spotter applies a small force to the leverage arm 193 for the eccentric muscle function.

Figure 18:
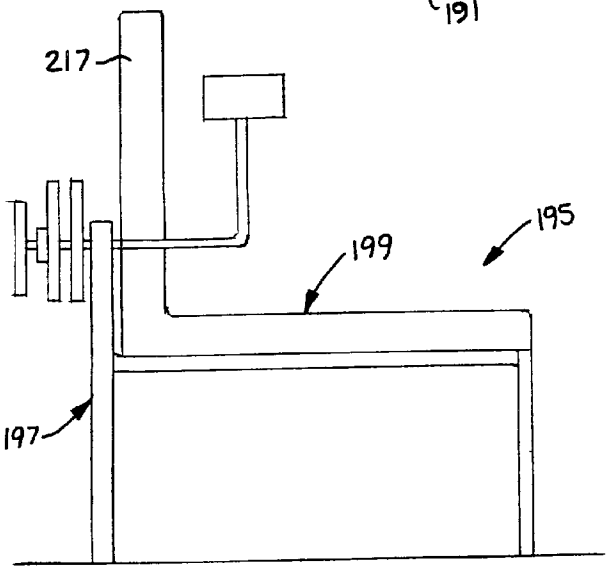
FIG. 18 is a schematic diagram of a side of an isolation exercise machine used to exercise latisimus dorsi muscles.

Now turning to FIGS. 18 an 19, an isolation exercise machine 195 is shown in schematic form. The exercise machine 195 has a tripod frame 197 and support 199 that may be substantially similar to the frame 149 and support 151, respectively, of the exercise machine 147 previously described in connection with FIGS. 15 and 16. In the illustrated construction, the frame 197 has a cross-brace 201 in which are journalled the shafts 203A and 203B of respective exercise arms 205A and 205B. Each exercise arm 205A and 205B has but a single beam 206. On each exercise arm 205A and 205B is a respective force station 209A and 209B. The shafts 203A and 203B are connected by a drive train 207. In the machine 195, the leverage arm 213 is attached to the sprocket 215 of the exercise arm shaft 203B.

The isolation exercise machine 195 is an ideal application of the principle of the present invention that is shown schematically in FIG. 9. That is, a weight 211 is placed only on a weight bar 212 on a leverage arm 213.

A person uses the isolation exercise machine 195 by sitting on the support 199. He may place his back against the back rest 217 if the support is equipped with a back rest. He places the inside surfaces of his upper arms just above the elbows on the force stations 209A and 209B. Using his latisimus dorsi muscles, the person pushes downwardly against the force stations in a concentric function as shown by arrows F. The exercise arms 205A and 205B rotate in the directions of arrows 219 and 221, respectively. Because the leverage arm 213 is attached to the sprocket 215 associated with the exercise arm 205B, the leverage arm rotates in the direction of arrow 221 and raises the weight 211.

At the end of the concentric muscle function, the person's elbows are close to the sides of his body. A spotter then applies a small force to the leverage arm 213 for the ensuing eccentric muscle function.

Each of the isolation exercise machines 1, 125, 147, 175, and 195 is shown without a counterweight arm. However, as explained previously, a counterweight arm similar to the counterweight arm 113 of the exercise machine 99 shown in FIG. 12 may be incorporated into any of the machines 1, 125, 147, 175, and 195. Alternately, a counterweight arm similar to the counterweight arm 119 of the machine 117 shown in FIG. 13 may be used. Similarly, a weight placed on the leverage arm, such as the weight 77 shown with the machine 71 of FIG. 9, may be used in addition to or in place of weights on the exercise arms in any of the machines 1, 125, 147, 175, or 195.

In summary, the results and advantages of exercising isolated pairs of human muscles can now be more fully realized. The isolation exercise machine of the present invention provides maximum efficiency to workouts by imposing different loads during concentric and eccentric muscle functions. This desirable result comes from using the combined functions of the leverage arm and the connection mechanism. The connection mechanism causes equal and opposite rotations of the exercise arms in a manner suitable for exercising a single pair of muscles. The leverage arm rotates with one of the exercise arms. Weights are placed on either or both the exercise arms and the leverage arm. During a concentric muscle function, the weights are raised to impose a first load on the person. During an eccentric muscle function, a small force is applied to the leverage arm. The small applied force is magnified and converted into second loads at the force stations. The same principles of physics and the same basic machine components of a tripod frame, support, and connection mechanism are applicable to exercising a wide variety of pairs of muscles. The force stations are adjustable to suit the particular muscles to be exercised as well as to suit the exercising person. A counterweight arm with a counterweight may be incorporated into any of the machines for canceling out the weight of the leverage arm.

It will also be recognized that in addition to the superior performance of the isolation exercise machines, their construction is such as to cost little, if any, more than traditional isolation exercise machines. In fact, because of the versatility of the tripod frame, support, and connection mechanism, the same basic machine is suitable for exercising a wide variety of pairs of muscles.

Thus, it is apparent that there has been provided, in accordance with the invention, an isolation exercise machine with leverage arm that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An isolation exercise machine comprising:

a. a frame restable on a floor;

b. first and second rotatable force stations;

c. a connection mechanism rotatable in the frame and connecting the first and second force stations such that the force stations rotate in opposite directions in response to rotating either or both force stations, and wherein the connection mechanism comprises:

i. first and second exercise arms having respective first and second shafts rotatable in the frame, the first and second force stations being joined to the first and second exercise arms, respectively; and ii. a drive train connecting the exercise arms shafts to rotate them in opposite directions in response to a person exerting a force on either or both force stations, and wherein the drive train comprises: first and second sprockets on the first shaft, and third and fourth sprockets on the second shaft; means for connecting the first and third sprockets to each other; and means for connecting the second and fourth sprockets to each other and for cooperating with the means for connecting the first and third sprockets to cause the first and second shafts to rotate in opposite directions in response to rotation of either shaft, so that the first and second force stations rotate in opposite directions in response to rotation of either exercise arm;

d. a support mounted to the frame at a selected location that enables a person supported on the support to place selected limbs against the force stations and rotate the force stations in respective first opposite directions in response to the person exerting concentric muscle functions on the force stations, and rotate the force stations in respective second opposite directions in response to the person exerting eccentric muscle functions on the force stations;

e. a leverage arm attached to the connection mechanism to which a selected force is applied while the person exerts the eccentric muscle functions on the force stations; and f. at least one first weight placeable on at least one of the connection mechanism and the leverage arm that produces loads on the first and second force stations that resist the concentric muscle functions exerted by the person.

2. The isolation exercise machine of claim 1 wherein:

a. each exercise arm comprises first and second beams;

b. the first force station is joined to the first beam of the first exercise arm, and the second force station is joined to the first beam of the second exercise arm; and c. said at least one first weight is removeably placeable on the second beam of at least one of the first and second exercise arms.

3. The isolation exercise machine of claim 2 wherein each force station is adjustable along the associated exercise arm first beam.

4. The isolation exercise machine of claim 1 wherein:

a. the means for connecting the first and third sprockets comprises a first chain having a first end fixed to the first sprocket and a second end fixed to the third sprocket; and b. the means for connecting the second and fourth sprockets comprises a second chain having a first end fixed to the second sprocket and a second end fixed to the fourth sprocket; and c. the first and second chains are arranged in a figure-eight configuration that produces opposite rotations of the exercise arms.

5. The isolation exercise machine of claim 1 wherein the support is mounted to the frame at a location relative to the force stations that enables the person supported on the support to exercise pectoral muscles of the person.

6. The isolation exercise machine of claim 1 wherein the support is mounted to the frame at a location relative to the force stations that enables the person supported on the support to exercise inner thigh muscles of the person.

7. The isolation exercise machine of claim 1 wherein the support is mounted to the frame at a location relative to the force stations that enables the person supported on the support to exercise posterior deltoid muscles of the person.

8. The isolation exercise machine of claim 1 wherein the support is mounted to the frame at a location relative to the force stations that enables the person supported on the support to exercise lateral deltoid muscles of the person.

9. The isolation exercise machine of claim 1 wherein:

a. the leverage arm has a first end that is attached to the first sprocket; and b. the leverage arm has a second end that has an angled section that is contactable with the floor.

10. The isolation exercise machine of claim 1 wherein:

a. the leverage arm has a first end that is attached to the first sprocket; and b. the leverage arm comprises an adjuster proximate a leverage arm second end that is contactable with the floor.

11. The isolation exercise machine of claim 10 wherein the adjuster comprises:

a. a sleeve pivotally connected to the leverage arm b. a column slideable in the sleeve and defining at least one hole; and c. means for coacting with the sleeve and said at least one column hole to locate the column at a selected location within the sleeve.

12. The isolation exercise machine of claim 1 wherein:

a. the leverage arm possesses a leverage arm weight; and b. the isolation exercise machine further comprises means for canceling out the leverage arm weight.

13. The isolation exercise machine of claim 1 wherein:

a. the leverage arm is attached to the first sprocket on a first side of the first shaft;

b. the leverage arm possesses a leverage arm weight that creates a first torque about the first shaft;

c. a counterweight arm is attached to the first sprocket on the opposite side of the first shaft as the leverage arm; and d. a selected counterweight is placeable on the counterweight arm that creates a second torque equal and opposite the first torque to thereby cancel out the leverage arm weight.

14. The isolation exercise machine of claim 1 wherein:

a. the first and third sprockets have respective first and second sides that are on opposite sides of the respective first and second shafts;

b. the leverage arm is attached to the first side of the first sprocket;

c. the leverage arm possesses a leverage arm weight that creates a first torque about the first shaft;

d. a counterweight arm with a counterweight is joined to the first side of the third sprocket; and e. the counterweight arm and counterweight create a second torque equal and opposite the first torque to thereby cancel out the leverage arm weight.

15. The isolation exercise machine of claim 1 wherein:

a. each exercise arm comprises at least one beam; and b. each force station comprises:

i. a collar slideable along said at least one beam;

ii. a pad secured to the collar; and iii. means for releasably locking the collar to selected locations along said at least one beam.

16. Apparatus for exercising selected pairs of human muscles comprising:

a. a frame restable on a floor;

b. a support mounted to the frame;

c. first and second force stations located relative to the support so as to enable a person supported on the support to place selected limbs against the force stations;

d. a connection mechanism connecting the first and second force stations to each other so as to produce first opposite rotations thereof in response to the person exerting first forces with the selected limbs against the force stations;

e. a leverage arm possessing a leverage arm weight and attached to the connection mechanism, a predetermined force being selectively applied to the leverage arm wherein the leverage arm is selectively contactable with the floor; and f. a first weight placeable on at least one of the connection mechanism and the leverage arm that imposes first loads at the first and second force stations that resist the first forces exerted by the person, wherein the predetermined force applied to the leverage arm is converted by the connection mechanism into second loads at the force stations that are additive to the first loads and that are resisted by second forces exerted by the person against the force stations.

17. The apparatus of claim 16 wherein the first and second force stations are adjustable on the connection mechanism relative to the support to enable the person to adjust the placement of the selected limbs against the force stations.

18. The apparatus of claim 16 wherein the connection mechanism comprises:

a. first and second exercise arms joined to the first and second force stations, respectively, and including first and second shafts, respectively, that rotate in the frame; and b. a drive train connecting the first and second shafts to produce opposite rotations of the exercise arms about their respective shafts.

19. The apparatus of claim 18 wherein:

a. each exercise arm comprises at least one beam; and b. each force station comprises means for adjusting the location of the force station along the associated exercise arm beam.

20. The apparatus of claim 18 wherein:

a. each exercise arm comprises at least one beam; and b. each force station comprises:

i. a collar slideable along said at least one beam;

ii. a pad secured to the collar; and iii. means for releasably locking the collar at a selected location on said at least one beam.

21. The apparatus of claim 18 wherein the drive train comprises:

a. first and second pairs of sprockets in operative association with the exercise arm shafts; and b. means for connecting the first and second pairs of sprockets in a manner that produces opposite rotations of the exercise arm shafts in response to rotating either exercise arm.

22. The apparatus of claim 21 wherein:

a. the leverage arm is attached to a selected sprocket on a first side of the associated exercise arm shaft, the leverage arm acting to create a first torque about the associated exercise arm shaft;

b. a counterweight arm is joined to the selected sprocket on a second side of the associated exercise arm shaft; and c. a selected counterweight is placed on the counterweight arm that cooperates with the counterweight arm to create a second torque equal and opposite the first torque and thereby cancels out the leverage arm weight.

23. The apparatus of claim 21 wherein:

a. the leverage arm is attached to a first sprocket that is in operative association with the first exercise arm shaft, the leverage arm acting to create a first torque about the first exercise arm shaft;

b. a counterweight arm is joined to a second sprocket that is in operative association with the second exercise arm shaft; and c. a counterweight is on the counterweight arm and cooperates therewith to create a second torque that is equal and opposite the first torque.

24. The apparatus of claim 16 wherein the first and second force stations are located relative to the support so as to enable the person supported on the support to place upper arms of the person against the force stations.

25. The apparatus of claim 16 wherein the first and second force stations are located relative to the support so as to enable the person supported on the support to place knees of the person against the force stations.

26. The apparatus of claim 16 wherein:

a. each exercise arm comprises first and second beams;

b. the first and second force stations are joined to the first beams of the first and second exercise arms, respectively; and c. the second beam of at least one of the first and second exercise arms comprises means for holding the first weight.

27. The apparatus of claim 26 wherein the first and second beams make an acute angle with each other.

28. The apparatus of claim 26 wherein the first and second beams make an obtuse angle with each other.

29. The apparatus of claim 16 further comprising an adjuster on the leverage arm that is selectively contactable with the floor.

30. The apparatus of claim 16 further comprising means for canceling out the leverage arm weight.

31. The apparatus of claim 16 wherein the predetermined force selectively applied to the leverage arm comprises a small weight selectively placed on the leverage arm.

* * * * *